US008322883B2

(12) United States Patent
Cleaver et al.

(10) Patent No.: US 8,322,883 B2
(45) **Date of Patent: *Dec. 4, 2012**

(54) FLEXIBLE ILLUMINATION DEVICE FOR SIMULATING NEON LIGHTING

(75) Inventors: Mark J. Cleaver, Wilmette, IL (US); George R. Hulse, Cookeville, TN (US); Joe A. Chambers, Cookeville, TN (US); John R. Dominick, Cookeville, TN (US)

(73) Assignee: iLight Technologies, Inc., Chicago, IL (US)

( * ) Notice: Subject to any disclaimer, the term of this patent is extended or adjusted under 35 U.S.C. 154(b) by 1373 days.

This patent is subject to a terminal disclaimer.

(21) Appl. No.: 10/771,714

(22) Filed: Feb. 4, 2004

(65) Prior Publication Data

US 2004/0168359 A1 Sep. 2, 2004

Related U.S. Application Data

(60) Provisional application No. 60/444,887, filed on Feb. 4, 2003.

(51) Int. Cl.
*F21V 21/00* (2006.01)

(52) U.S. Cl. ..... 362/249.04; 362/249.02; 362/278

(58) Field of Classification Search ..... 362/217, 362/495, 540, 544, 545, 555, 103–106, 108, 362/133, 134, 152, 189, 198, 218, 225, 227, 362/235, 236, 240–246, 249, 278, 310, 311, 362/326, 329, 800, 806, 812, 217.01–217.05, 362/217.12–217.16, 219–224, 249.01–249.08, 362/249.14–249.19, 277, 296.01, 327, 565, 362/570, 571

See application file for complete search history.

(56) References Cited

U.S. PATENT DOCUMENTS

| | | | | |
|---|---|---|---|---|
| 1,348,698 | A | 8/1920 | Coulson | |
| 4,111,520 | A | 9/1978 | Bernal | |
| 4,195,907 | A * | 4/1980 | Zamja et al. | 385/125 |
| 4,298,869 | A | 11/1981 | Okuno | |
| 4,376,946 | A | 3/1983 | Kaminow et al. | |
| 4,422,719 | A | 12/1983 | Orcutt | |
| 4,597,033 | A | 6/1986 | Meggs et al. | |
| 4,607,317 | A | 8/1986 | Lin | |

(Continued)

FOREIGN PATENT DOCUMENTS

DE 29706201 3/1997

(Continued)

OTHER PUBLICATIONS

Tivoli Industries, Inc., "Electroluminescent Accent and Guide Lighting" product brochure, pp. 1-2.

(Continued)

*Primary Examiner* — Hargobind S Sawhney
(74) *Attorney, Agent, or Firm* — Fitch Even Tabin & Flannery

(57) ABSTRACT

An illumination device includes a flexible and substantially rod-like member having a predetermined length with a light-receiving surface and a light-emitting surface and an elongated light source extending along and positioned adjacent the light-receiving surface of the rod-like member, such that light entering the rod-like member from the elongated light source and through the light-receiving surface is preferentially scattered, thus causing a light intensity pattern that appears substantially uniform along the light-emitting surface of the rod-like member.

5 Claims, 4 Drawing Sheets

U.S. PATENT DOCUMENTS 4,630,180 A 12/1986 Muraki et al.
4,767,172 A 8/1988 Nichols et al.
4,785,567 A 11/1988 Consiglio
4,811,507 A * 3/1989 Blanchet ..... 40/546
4,847,734 A * 7/1989 Katoh et al. ..... 362/555
4,891,896 A 1/1990 Boren
4,901,207 A * 2/1990 Sato et al. ..... 362/555
4,908,743 A * 3/1990 Miller ..... 362/238
4,941,072 A 7/1990 Yasumoto et al.
4,976,057 A 12/1990 Bianchi
4,996,632 A 2/1991 Aikens
5,032,960 A 7/1991 Katoh
5,057,981 A 10/1991 Bowen et al.
5,140,220 A 8/1992 Hasegawa
5,151,679 A 9/1992 Dimmick
5,161,872 A 11/1992 Sasaki et al.
5,187,377 A * 2/1993 Katoh ..... 257/89
5,201,020 A 4/1993 Kannabiran
5,219,217 A 6/1993 Aikens
5,295,047 A 3/1994 Windross
5,301,090 A 4/1994 Hed
5,303,133 A 4/1994 Wagner
5,365,411 A 11/1994 Rycroft et al.
5,375,043 A 12/1994 Tokunaga
5,410,453 A 4/1995 Ruskouski
5,416,679 A 5/1995 Ruskouski et al.
5,459,955 A 10/1995 Ruskouski et al.
5,475,786 A 12/1995 Nishiguchi et al.
5,497,440 A 3/1996 Croitoru et al.
5,526,236 A 6/1996 Burnes et al.
5,537,297 A 7/1996 Ghandehari
5,559,681 A * 9/1996 Duarte ..... 362/252
5,581,683 A 12/1996 Bertignoll et al.
5,588,236 A 12/1996 Suzuki
5,607,227 A 3/1997 Yasumoto et al.
5,613,751 A 3/1997 Parker et al.
5,618,096 A 4/1997 Parker et al.
5,640,792 A 6/1997 Smith et al.
5,661,374 A * 8/1997 Cassidy et al. ..... 315/307
5,694,513 A 12/1997 Okaniwa
5,812,714 A 9/1998 Hulse
5,818,998 A 10/1998 Harris et al.
5,842,297 A 12/1998 Tung
5,852,514 A 12/1998 Toshima et al.
5,876,107 A 3/1999 Parker et al.
5,879,076 A 3/1999 Cross
5,887,968 A 3/1999 Logan
5,921,652 A 7/1999 Parker et al.
5,931,570 A 8/1999 Yamuro
5,934,792 A 8/1999 Camarota
5,941,626 A 8/1999 Yamuro
5,950,340 A 9/1999 Woo
5,964,518 A 10/1999 Shen
5,982,969 A * 11/1999 Sugiyama et al. ..... 385/123
5,996,263 A 12/1999 Black
6,023,869 A 2/2000 Durbin
6,042,248 A 3/2000 Hannah et al.
6,075,652 A 6/2000 Ono et al.
6,076,294 A 6/2000 Durbin
6,079,838 A 6/2000 Parker et al.
6,095,673 A 8/2000 Goto et al.
6,123,442 A 9/2000 Freier et al.
6,146,006 A 11/2000 Cross
6,158,882 A 12/2000 Bischoff, Jr.
6,168,302 B1 1/2001 Hulse
6,173,517 B1 1/2001 Eibner et al.
6,186,645 B1 2/2001 Camarota
6,193,385 B1 2/2001 Maki et al.
6,204,899 B1 3/2001 Hall
6,217,184 B1 4/2001 Koike et al.
6,217,201 B1 4/2001 Hulse
6,244,734 B1 6/2001 Hulse
6,260,991 B1 7/2001 Hulse
6,275,338 B1 8/2001 Arai et al.
6,283,612 B1 9/2001 Hunter
6,297,906 B1 10/2001 Allen et al.
6,297,908 B1 10/2001 Suga
6,354,714 B1 3/2002 Rhodes
6,361,186 B1 3/2002 Slayden
6,366,727 B1 4/2002 Nojiri et al.
6,394,623 B1 5/2002 Tsui
6,406,158 B1 6/2002 Ohkawa
6,447,133 B1 9/2002 Eschke et al.
6,481,130 B1 11/2002 Wu
6,582,103 B1 6/2003 Popovich et al.
6,592,238 B2 7/2003 Cleaver et al.
6,673,292 B1 * 1/2004 Gustafson et al. ..... 264/149
6,673,293 B1 * 1/2004 Mistopoulos et al. ..... 264/149
6,676,284 B1 1/2004 Wilson
6,796,680 B1 * 9/2004 Showers et al. ..... 362/246
6,846,094 B2 * 1/2005 Luk ..... 362/252
6,851,832 B2 * 2/2005 Tieszen ..... 362/249
6,860,628 B2 * 3/2005 Robertson et al. ..... 362/555
2002/0093832 A1 * 7/2002 Hamilton ..... 362/555

FOREIGN PATENT DOCUMENTS

DE 29803723 2/1998
EP 0962789 A2 12/1999
JP 61-165583 10/1986

OTHER PUBLICATIONS

Neo-Neon, "2000 The Light of the Next Millennium" Lighting System Catalog: 1999-2000, Duralight product information pp. 10-21.
IPEA/US, International Preliminary Report on Patentability, Mar. 30, 2006, pp. 1-6.

* cited by examiner

FLEXIBLE ILLUMINATION DEVICE FOR SIMULATING NEON LIGHTING

CROSS-REFERENCE TO RELATED APPLICATIONS

The present application claims priority to U.S. Provisional Application Ser. No. 60/444,887 filed Feb. 4, 2003, the entire disclosure of which is incorporated herein by reference.

BACKGROUND OF THE INVENTION

The present invention relates to an illumination device for simulating neon lighting using high-intensity, low-voltage light sources, an illumination device ideally adapted for lighting, signage and advertising uses.

Neon lighting, which is produced by the electrical stimulation of the electrons in the low-pressure neon gas-filled glass tube, has been a main stay in advertising and for outlining channel letters and building structures for many years. A characteristic of neon lighting is that the tubing encompassing the gas has an even glow over its entire length irrespective of the viewing angle. This characteristic makes neon lighting adaptable for many advertising applications, including script writing and designs, because the glass tubing can be fabricated into curved and twisted configurations simulating script writing and intricate designs. The even glow of neon lighting being typically devoid of hot spots allows for advertising without visual and unsightly distractions. Thus, any illumination device that is developed to duplicate the effects of neon lighting must also have even light distribution over its length and about its circumference. Equally important, such lighting devices must have a brightness that is at least comparable to neon lighting. Further, since neon lighting is a well-established industry, a competitive lighting device must be lightweight and have superior "handleability" characteristics in order to make inroads into the neon lighting market. Neon lighting is recognized as being fragile in nature. Because of the fragility and heavy weight, primarily due to its supporting infrastructure, neon lighting is expensive to package and ship. Moreover, it is extremely awkward to initially handle, install, and/or replace. Any lighting device that can provide those previously enumerated positive characteristics of neon lighting, while minimizing its size, weight, and handleability shortcomings, will provide for a significant advance in the lighting technology.

The more recent introduction of lightweight and breakage resistant point light sources, as exemplified by high-intensity light-emitting diodes, have shown great promise to those interested in illumination devices that may simulate neon lighting and have stimulated much effort in that direction. However, the twin attributes of neon lighting, uniformity and brightness, have proven to be difficult obstacles to overcome as such attempts to simulate neon lighting have largely been stymied by the tradeoffs between light distribution to promote the uniformity and brightness. For example, U.S. Pat. No. 4,976,057 issued Dec. 11, 1990 to Bianchi describes a device that includes a transparent or translucent hollow plastic tubing mounted in juxtaposition to a sheet of material having light transmitting areas that are co-extensive to the tubing. The sheet is backlit by light sources such as LEDs which trace the configuration of the tubing. The tubing can be made into any shape including lettering. While the tubing may be lit by such arrangement, the light transfer efficiencies with such an arrangement is likely to result in a "glowing" tube having insufficient intensity to match that of neon lighting. The use of point light sources such as LEDs may provide intense light that rival or exceed neon lighting, but when arranged in arrays, lack the uniformity needed and unfortunately provide alternate high and low intensity regions in the illuminated surfaces. Attempts to smooth out the light have resulted in lighting that has unacceptably low intensity levels.

In an attempt to address some of the shortcomings of neon, commonly assigned U.S. Pat. No. 6,592,238, which has been incorporated in its entirety herein by reference, describes an illumination device comprising a profiled rod of material having waveguide properties that preferentially scatters light entering one lateral surface ("light-receiving surface") so that the resulting light intensity pattern emitted by another lateral surface of the rod ("light-emitting surface") is elongated along the length of the rod. A light source extends along and is positioned adjacent the light-receiving surface and spaced from the light-emitting surface a distance sufficient to create an elongated light intensity pattern with a major axis along the length of the rod and a minor axis that has a width that covers substantially the entire circumferential width of the light-emitting surface. In a preferred arrangement, the light source is a string of point light sources spaced a distance apart sufficient to permit the mapping of the light emitted by each point light source into the rod so as to create elongated and overlapping light intensity patterns along the light-emitting surface and circumferentially about the surface so that the collective light intensity pattern is perceived as being uniform over the entire light-emitting surface.

One of the essential features of the illumination device described and claimed in U.S. Pat. No. 6,592,238 is the uniformity and intensity of the light emitted by the illumination device. While it is important that the disadvantages of neon lighting be avoided (for example, weight and fragility), an illumination device would have little commercial or practical value if the proper light uniformity and intensity could not be obtained. This objective is achieved primarily through the use of a "leaky" waveguide rod. A "leaky" waveguide is structural member that functions both as an optical waveguide and light scattering member. As a waveguide, it tends to preferentially direct light entering the waveguide, including the light entering a lateral surface thereof, along the axial direction of the waveguide, while as a light scattering member, it urges the light out of an opposite lateral surface of the waveguide. As a result, what is visually perceived is an elongated light pattern being emitted along the light-emitting lateral surface of the waveguide.

As described in U.S. Pat. No. 6,592,238, certain acrylics, polycarbonates, and epoxys have the desired preferential light scattering properties needed to produce a leaky waveguide; for example, one such acrylic material is commercially available from AtoHaas, Philadelphia, Pa. under order number DR66080. These compounds are extremely lightweight and are able to withstand rough shipping and handling. These compounds can be easily molded or extruded into a desired shape for a particular illumination application and thereafter heated and bent to a final desired shape or shapes. While these compounds have the desired preferential light scattering properties, their structural flexibility is somewhat limited.

Increasing the structural flexibility of the material used to create a neon-simulating illumination device would significantly enhance its desirability. For example, a more flexible illumination device would be able to withstand even greater physical strain; it could be flexed, bent, or hit without being damaged. Additionally, a highly flexible illumination device could be bent into a desired final shape or shapes without needing to be heated. With sufficient flexibility, it is contemplated that the illumination device could even be shaped at a location away from the manufacturing facility; for example, retailers or consumers could bend and shape the product upon receipt. Polymers now exist that have greater flexibility then those compounds known to have preferential light scattering properties; however, a more flexible polymer that also has the requisite light scattering properties is not known.

It is therefore an object of the present invention to provide an illumination device with a leaky waveguide made from a material having all the benefits of known light-scattering compounds with the additional benefit of enhanced flexibility.

This and other objects and advantages of the present invention will become readily apparent and addressed through a reading of the discussion below and appended drawings.

SUMMARY OF THE INVENTION

The present invention is an illumination device that is an effective simulator of neon lighting in that it provides for an essentially uniform light intensity distribution pattern over its entire lateral light-emitting surface, but equally important, the illumination device has enhanced flexibility. To accomplish this, the preferred illumination device uses a high-intensity, but dimensionally small, light source (e.g., high-intensity, light-emitting diodes) together with an element that acts both as an optical waveguide and light scattering member, thus permitting light to exit laterally out of its surface, a so-called "leaky waveguide." By placing the light source contiguous such a leaky waveguide in a specific manner so as to cause the waveguide to uniformly glow over its light-emitting surface, applicants are able to obtain an illumination device that rivals or surpasses the uniform glow of neon tubing.

As mentioned above, known compounds used to produce leaky waveguides have limited flexibility, while compounds with enhanced flexibility generally do not have the requisite light scattering properties. Therefore, a flexible compound, such as polyurethane, silicone, or silicone rubber, is impregnated with a filler to give the compound the desired light scattering properties and allow it to serve as a leaky waveguide.

One exemplary embodiment of an illumination device made in accordance with the present invention generally comprises a waveguide, a housing, and a light source. The waveguide is the aforementioned leaky waveguide made from a flexible compound, such as polyurethane, silicone, or silicone rubber, impregnated with a filler to promote the desired light scattering. Light entering the waveguide of the illumination device from the light source is thus preferentially scattered so as to exit with a broad elongated light intensity distribution pattern out of the light-emitting surface of the waveguide so as to simulate neon lighting. At the same time, the illumination device has significantly enhanced flexibility, improving its durability and allowing it to be bent or manipulated into various shapes without the application of heat.

Another exemplary embodiment of an illumination device made in accordance with the present invention generally comprises a waveguide with an external light-emitting surface and a light source, with the light source and associated electrical accessories being essentially enclosed within the waveguide. The waveguide is the aforementioned leaky waveguide made from a flexible compound, such as polyurethane, silicone, or silicone rubber, impregnated with a filler to promote the desired light scattering. Light entering the waveguide of the illumination device from the light source is preferentially scattered so as to exit with a broad elongated light intensity distribution pattern out of the light-emitting surface of the waveguide. At the same time, the illumination device has significantly enhanced flexibility, improving its durability and allowing it to be bent or manipulated into various shapes without the application of heat.

DETAILED DESCRIPTION OF THE INVENTION

Figure 1:
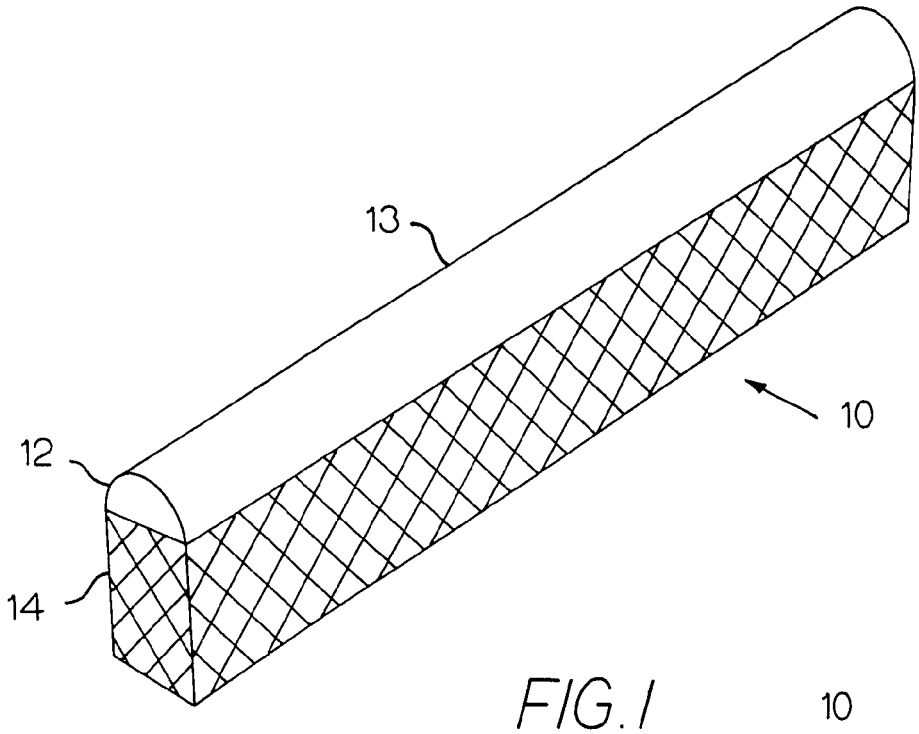
FIG. 1 is a perspective view of an exemplary embodiment of an illumination device made in accordance with the present invention.

The present invention is an illumination device that is an effective simulator of neon lighting in that it provides for an essentially uniform light intensity distribution pattern over its entire lateral surface, but equally important, the illumination device has enhanced flexibility.

To accomplish this, the preferred illumination device uses a high-intensity, but dimensionally small, light source together with an element that acts both as an optical waveguide and light scattering member, thus permitting light to exit laterally out of its surface. As described in U.S. Pat. No. 6,592,238, which has been incorporated in its entirety by reference, this element is referred to as a "leaky waveguide." By placing the light source contiguous such a leaky waveguide in a specific manner so as to cause the waveguide to uniformly glow over its light-emitting surface, applicants are able to obtain an illumination device that rivals or surpasses the uniform glow of neon tubing.

There are many light sources which provide the necessary light intensity; however, a preferred light source for the purpose here intended is a series of contiguously mounted point light sources, such as high-intensity, light-emitting diodes—LEDs. By spacing the LEDs a certain distance apart, and positioning each LED an appropriate distance from the leaky waveguide, the light intensity distribution patterns on the surface of the of the leaky waveguide are caused to overlap to such an extent that the variations in the patterns are evened out. This causes the collective light pattern on the light-emitting surface of the waveguide to appear to an observer to have a uniform intensity along the length of the waveguide.

As mentioned above, it would be beneficial to provide an illumination device that is highly flexible; however, compounds used to produce leaky waveguides have limited flexibility. Many flexible compounds are known; however, these compounds do not have the requisite light scattering properties. Therefore, they must undergo a modification process to obtain light-scattering properties before being used as a leaky waveguide in the illumination device of the present invention. In choosing a compound to so modify, care must be taken to ensure that it is extremely lightweight and can be easily molded or extruded into a desired shape for a particular illumination application.

Polyurethanes are one example of compounds which are lightweight and easily molded or extruded, but polyurethanes do not have an innate ability to scatter light. However, applicants have determined that filler may be incorporated into a polyurethane to give it the desired light scattering properties and allow it to serve as a leaky waveguide. Preferably, hollow spheres, called "micro balloons," are used to promote scattering. The micro balloons have approximately the same diameter as a human hair, are void in their interior, and have a shell constructed from glass or other material (and preferably having an index of refraction similar to that of polyurethane to minimize Fresnel losses at the interfaces between the polyurethane and the micro balloons). When light passes through the polyurethane material impregnated with micro balloons, the voids within the respective micro balloons act as a negative focusing lens, deflecting the light. Thus, once impregnated with appropriate micro-balloons, a polyurethane compound will also have the light scattering properties necessary for it to serve as the leaky waveguide of the present invention. Of course, it is contemplated that other materials, with the same or similar flexibility as polyurethane, could be modified using filler without departing from the spirit and scope of the present invention. Similarly, it is contemplated that other fillers having a different index of refraction than the flexible material, such as bubbles formed in the flexible material, could be used to achieve the desired light scattering properties without departing from the spirit and scope of the present invention.

In any event, one preferred polyurethane for this application is a polyurethane manufactured and distributed by IPN Industries, Inc. of Haverhill, Mass. as EGA-202 Clear and/or EGA-202 White.

Furthermore, as mentioned above, polyurethanes are not the only compounds suitable for use in the present invention. For example, applicants have determined that silicone or silicone rubber could also be used to construct the "leaky waveguide" of the present invention. Again, appropriate filler, such as micro balloons, is preferably incorporated into the silicone or silicone rubber material to give the compound the desired light scattering properties. One preferred silicone for this application is General Electric Silicone II, which is manufactured and distributed by GE Silicones, an operating division of GE Plastics headquartered in Waterford, N.Y. One preferred silicone rubber for this application is Silicone 55 Duro, which is manufactured and distributed by Silicone Rubber Right Products of Northlake, Ill.

Figure 2:
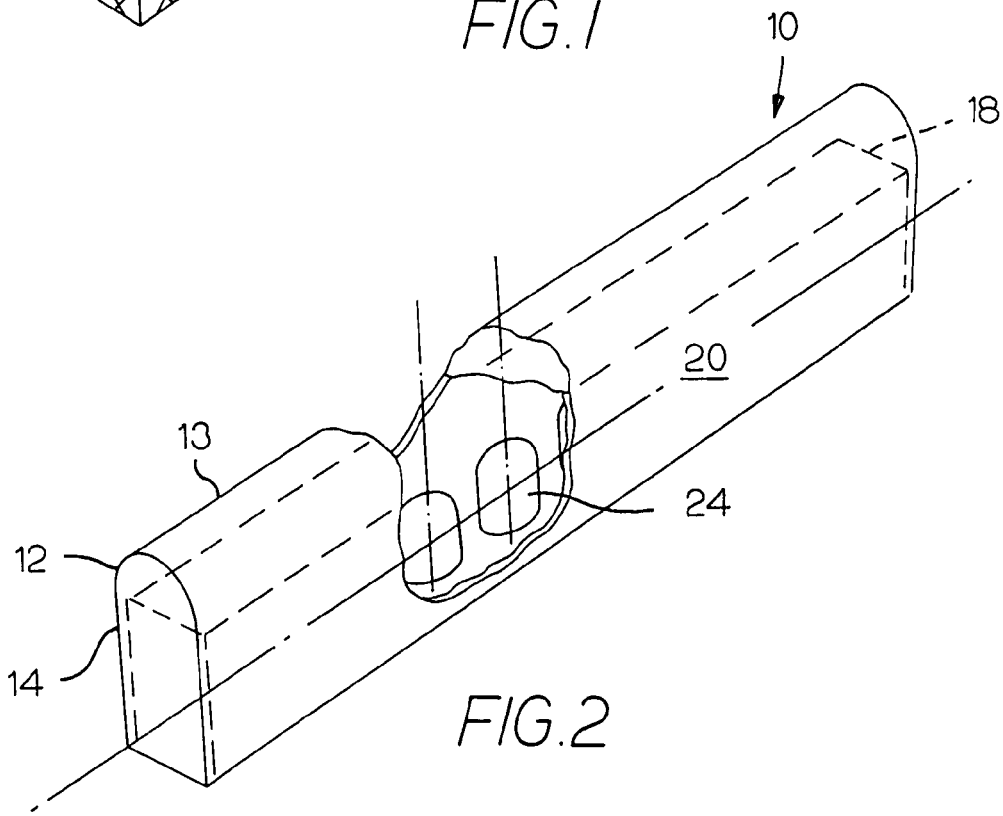
FIG. 2 is a perspective view similar to FIG. 1, but with a portion broken away to show the interior of the illumination device.
Figure 3:
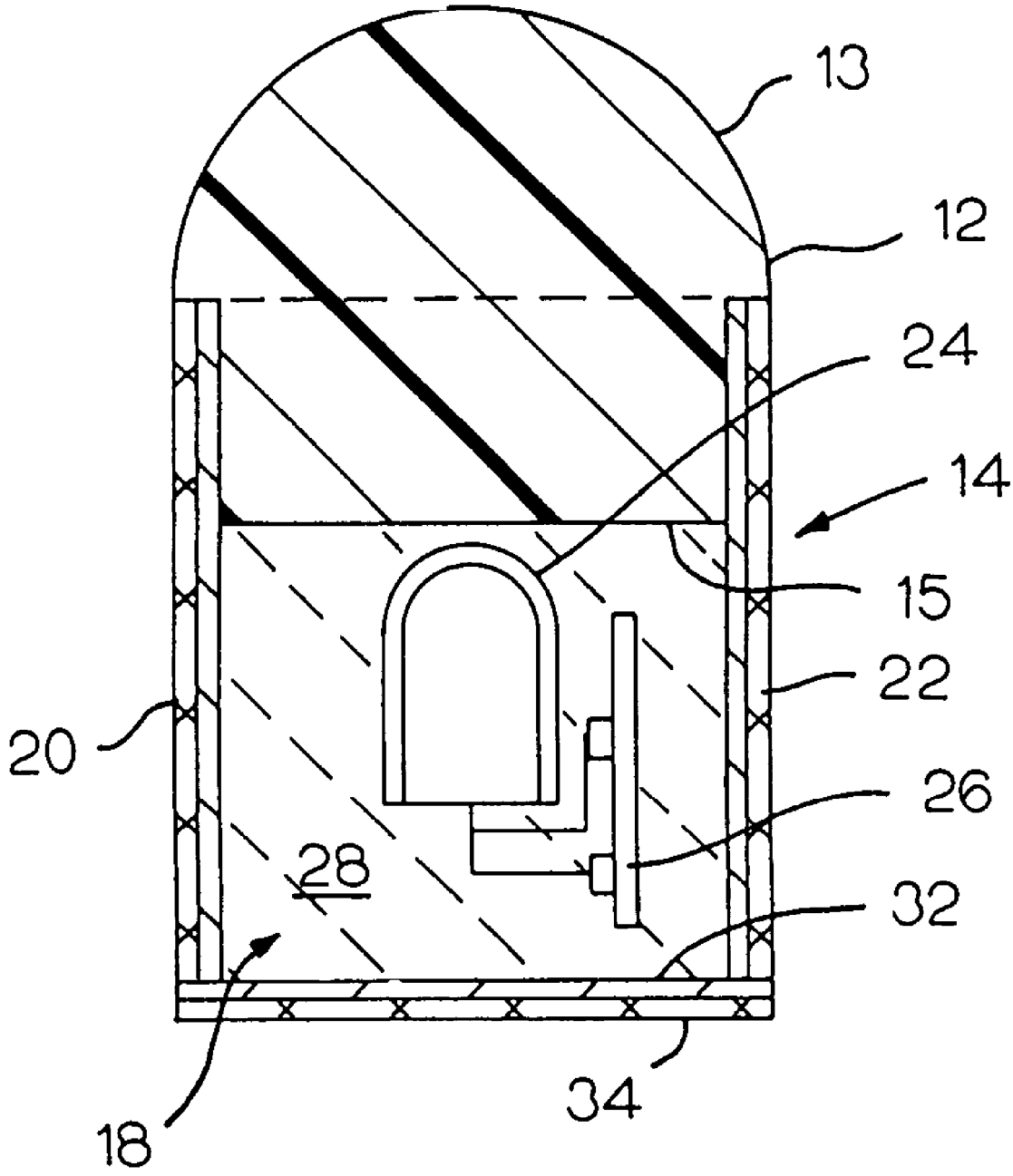
FIG. 3 is a sectional view of the illumination device of FIGS. 1 and 2.

Referring now to FIGS. 1-3, one exemplary embodiment of an illumination device 10 made in accordance with the present invention generally comprises a waveguide 12, a housing 14, and a light source 24. The waveguide 12 is the aforementioned leaky waveguide made from a compound, such as polyurethane, impregnated with micro balloons. In this exemplary embodiment, the waveguide 12 of the illumination device 10 is a rod-like member and has a curved lateral surface 13 serving as the light-emitting surface of the waveguide 12 and an internal lateral surface 15 (as best illustrated in FIG. 3) that serves as the light-receiving surface. Although such a geometry is desirable because it simulates a neon tube, the waveguide 12 of the present invention can be also be produced in various other shapes without departing from the spirit and scope of the present invention. In any event, light entering the waveguide 12 of the illumination device 10 from the light source 24 and through the light-receiving surface 15 is preferentially scattered so as to exit with a broad elongated light intensity distribution pattern out of the light-emitting surface 13.

As mentioned above and as illustrated in FIGS. 1-3, one preferred light source 24 is a plurality of LEDs spaced a predetermined distance from one another. The light source 24 and accompanying electrical accessories, including a flexible circuit board 26, are positioned within the housing 14. In this exemplary embodiment, the housing 14 is positioned below the waveguide 12 such that the light source 24 emits light into the light-receiving surface 15 of the waveguide. The housing 14 generally comprises a pair of side walls 20, 22 defining an open-ended channel 18 that extends substantially the length of waveguide 12. And, in this exemplary embodiment, the housing 14 also includes a floor portion 32, connecting the two side walls 20, 22 so that the housing has a substantially U-shape. The housing 14 preferably not only functions to house the light source 24 and electrical accessories, but also to collect light not emitted directly into the light-receiving surface 15 and redirect it to the waveguide 12. As such, as best illustrated in FIG. 3, the internal surfaces of the side walls 20, 22, and the floor portion 32 may be constructed of or coated with a light-reflecting material (e.g., white paint or tape) in order to increase the light collection efficiency by reflecting the light incident upon the internal surfaces of the housing 14 into the waveguide 12.

As a further refinement, from a viewer's perspective, it is desirable that the visual appearance of the housing 14 not be obtrusive with respect to the glowing, light-emitting surface 13 of the waveguide 12. Therefore, it is preferred that the outside surfaces of the housing 14 be constructed of or coated with a light absorbing material 34 (e.g., black paint or tape).

Finally, in the embodiment illustrated in FIGS. 1-3, the positioning of the light source 24 and electrical accessories within the channel 18 may be maintained by filling the channel 18 with potting material 28. The potting material 28 is made from a highly flexible material, similar to or the same as the material used to make the waveguide 12, resulting in an illumination device 10 with the desired flexibility. For example, the potting material 28 may be a compound having a different density of micro balloons then the compound (e.g., polyurethane) used to manufacture the waveguide 12, resulting in a construction in which the potting material 28 and the waveguide 12 have different indices of refraction. In this regard, by varying the relative densities of the micro balloons in the potting material 28 and the waveguide 12, light scattering can be manipulated to affect the ultimate light emission pattern at the light-emitting surface 13 of the waveguide 12.

In any event, an illumination device 10 illustrated in FIGS. 1-3 has significantly enhanced flexibility, improving its durability and allowing it to be bent or manipulated into various shapes without the application of heat.

Figure 4:
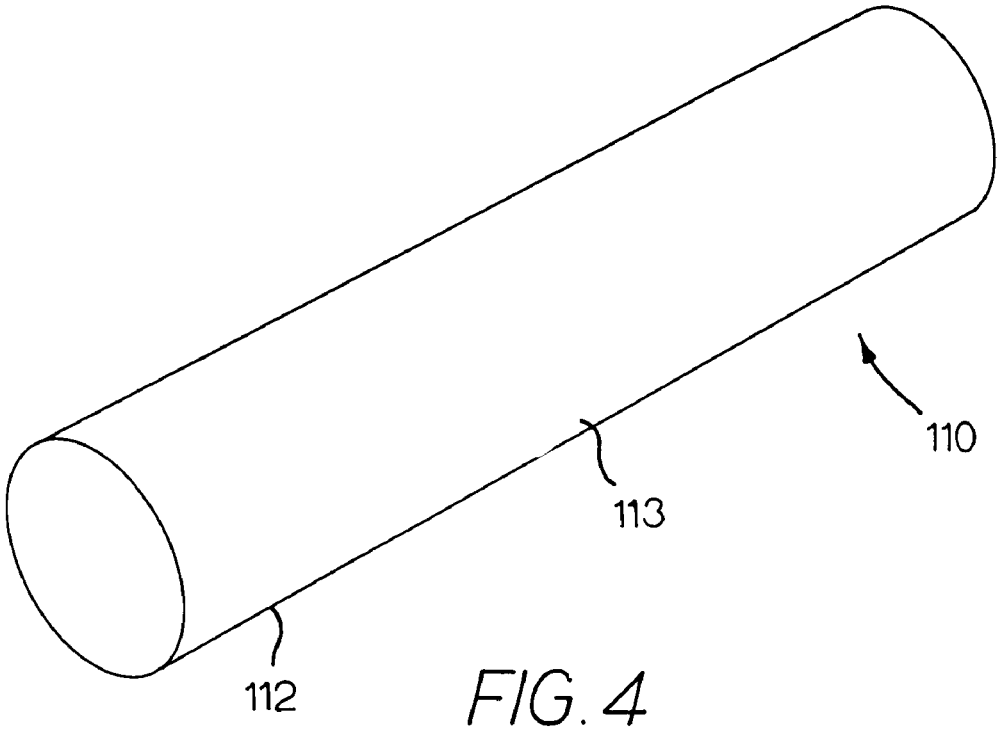
FIG. 4 is a perspective view of another exemplary embodiment of an illumination device made in accordance with the present invention.
Figure 5:
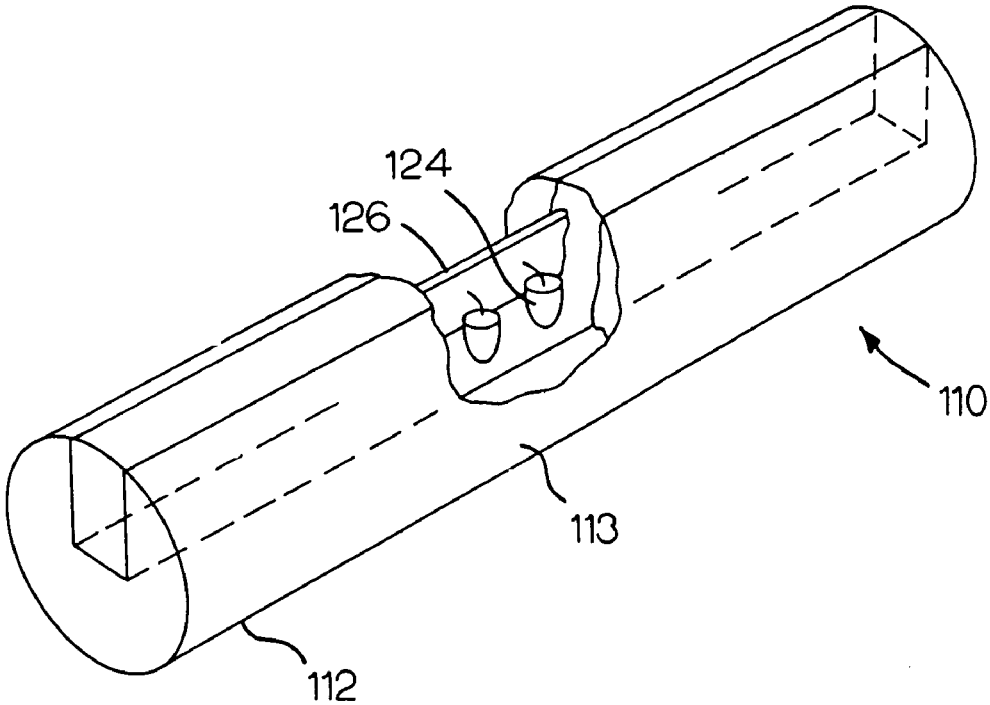
FIG. 5 is a perspective view similar to FIG. 4, but with a portion broken away to show the interior of the illumination device.
Figure 6:
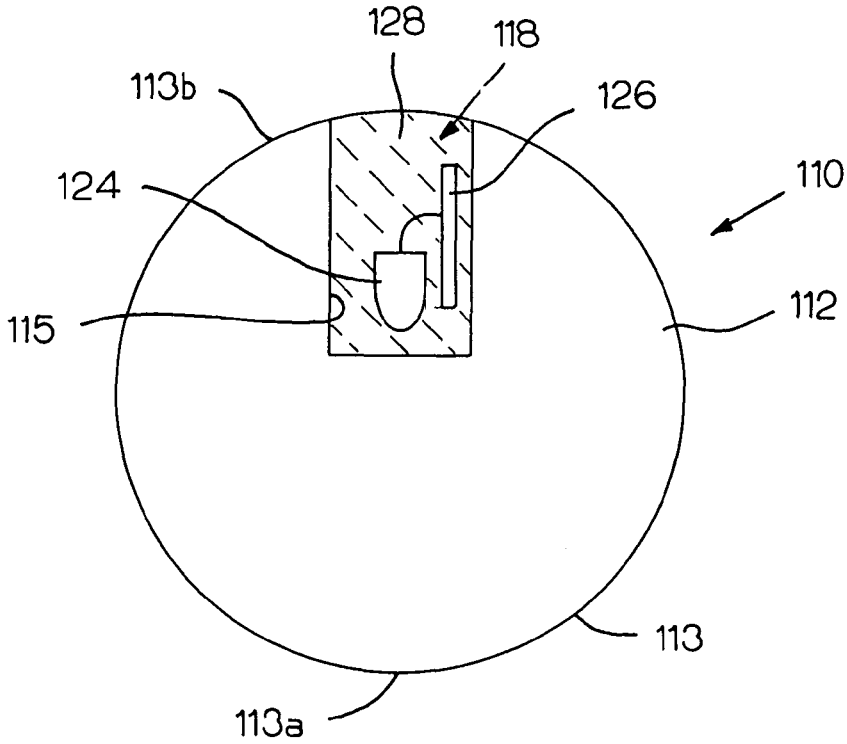
FIG. 6 is a sectional view of the illumination device of FIGS. 4 and 5.

FIGS. 4-6 illustrate another exemplary embodiment of an illumination device 110 made in accordance with the present invention. In this particular embodiment, the preferred illumination device is comprised of two primary components. The first component is a waveguide 112 with an external light-emitting surface 113, and the second component is a light source 124. Unlike the embodiment described with reference to FIGS. 1-3, there is no separate housing. Rather, the light source 124 and associated electrical accessories are essentially enclosed within the waveguide 112, as is further described below.

To achieve the desired flexibility, the waveguide 112 is the aforementioned leaky waveguide made from a compound, such as polyurethane, impregnated with micro balloons. Furthermore, as illustrated in FIGS. 4-6, the waveguide 112 of the illumination device 110 is generally rod-shaped with a circumferential light-emitting surface 113. Although a rod shape is preferred because it best simulates a neon tube, the waveguide 112 of the present invention can be produced in various shapes without departing from the spirit and scope of the present invention. In any event, light entering the waveguide 112 of the illumination device 110 from the light source 124 is preferentially scattered so as to exit with a broad elongated light intensity distribution pattern out of the light-emitting surface 113.

As mentioned above, the second major component of the preferred illumination device 110 is a light source 124. In the illustrated embodiment, the light source 124 is again a plurality of LEDs spaced a predetermined distance from one another. The light source 124 and accompanying electrical accessories, including a flexible circuit board 126, are inserted into a channel defined 118 in and extending along the length of the waveguide 112. Therefore, in this embodiment, the internal wall surfaces of the channel 118 actually serve as the light-receiving surface 115.

Finally, in the embodiment illustrated in FIGS. 4-6, the positioning of the light source 124 and electrical accessories within the channel 118 may be maintained by filling the channel 118 with potting material 128. The potting material 128 is made from a highly flexible material, similar to or the same as the material used to make the waveguide 112, resulting in an illumination device 110 with the desired flexibility. For example, the potting material 128 may be a compound having a different density of micro balloons then the compound (e.g., polyurethane) used to manufacture the waveguide 112, resulting in a construction in which the potting material 128 and the waveguide 112 have different indices of refraction. In this regard, by varying the relative densities of the micro balloons in the potting material 128 and the waveguide 112, light scattering can be manipulated to affect the ultimate light emission pattern at the light-emitting surface 113 of the waveguide 112.

In any event, the illumination device 110 illustrated in FIGS. 4-6 also has significantly enhanced flexibility, improving its durability and allowing it to be bent or manipulated into various shapes without the application of heat.

Figure 7:
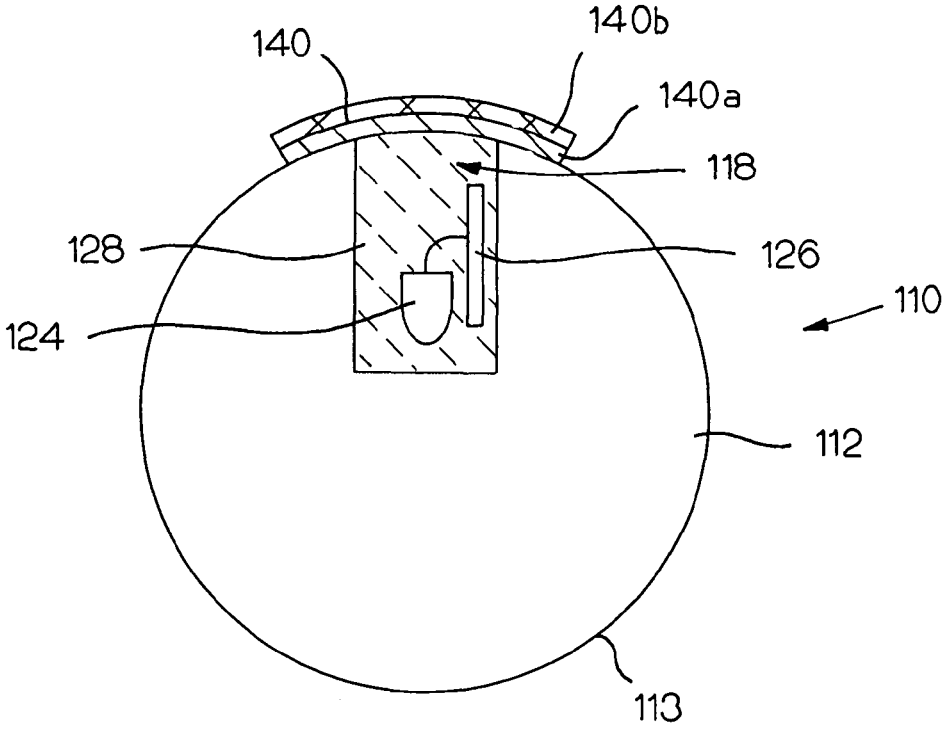
FIG. 7 is a sectional view of yet another exemplary embodiment of an illumination device made in accordance with the present invention, which is similar to that illustrated in FIGS. 4-6, but also includes a collection surface adjacent a portion of the outer surface of the waveguide.

FIG. 7 is a sectional view of yet another exemplary embodiment of an illumination device made in accordance with the present invention, which is very similar to that illustrated in FIGS. 4-6, but also includes a collection surface 140 adjacent a portion of the outer surface of the waveguide for collecting light not emitted directly into the waveguide 112. In other words, the light collection efficiency may be increased by directing by reflection the light incident upon the internal surfaces of the housing into the waveguide 112 to assist in the scattering of light. It is preferred that the collection surface 140 be made from a highly flexible material, similar to or the same as the material used to make the waveguide 112. Of course, the collection surface 140 could also be provided using tape, paint, or another coating. In any event, in the embodiment, illustrate din FIG. 7, the collection surface 140 actually has an inner, light-reflecting layer 140*a*, and an outer, light-absorbing layer 140*b*.

Also, it is noteworthy that the light scattering properties of the an illumination device 10, 110 made in accordance with the present invention can be manipulated by altering the density of micro balloons within the waveguide 12, 112. For example, increasing or decreasing the density of the micro balloons in the polyurethane or other compounds enhances or diminishes, respectively, its light-scattering properties. Thus, the amount of light allowed to exit through the leaky waveguide 12, 112 can be controlled. In addition to varying the density of the micro balloons within the waveguide 12, 112, the density could differ in certain portions of the waveguide 12, 112. For example, referring to the embodiment illustrated in FIGS. 4-6, a leaky waveguide 112 manufactured of a homogenous material tends to emit light primarily from the lateral surface 113 opposite from the light source 124, often referred to as the "front" lateral surface 113*a*. This effect is amplified when the light source 124 is placed at a greater distance from the front lateral surface 113*a*. By concentrating a greater density of micro balloons on the rear lateral surface 113*b*, light scattering on the rear lateral surface 113*b* can be intensified, thereby normalizing the light emission pattern around the entire lateral surface 113, creating a substantially 360-degree illumination effect.

In manufacturing a preferred leaky waveguide in accordance with the present invention, it is contemplated that various manufacturing methods could be used. For example, a molding process could be used to produce the waveguide with the micro balloons being inserted into the mold cavity and then encased in a urethane compounded injected into the mold cavity. Shaking the mold in some fashion could then be used to encourage homogenous dispersion of the micro balloons within the urethane compound. However, this is but one example of a preferred manufacturing methods, and other techniques and methods could certainly be employed without departing from the spirit and scope of the present invention.

It will be obvious to those skilled in the art that other modifications may be made to the invention as described herein without departing from the spirit and scope of the present invention.

The invention claimed is:

1. An illumination device for simulating neon lighting, comprising:

a solid rod-like member having a predetermined length with a light-receiving surface and a light-emitting surface, said rod-like member being composed of a substantially flexible compound;

a flexible circuit board disposed within said rod-like member;

a multiplicity of spaced point light sources arranged in a line along said flexible circuit board and extending substantially along the light-receiving surface of said rod-like member, the spaced point light sources and the flexible circuit board being in direct physical contact with the rod-like member such that light entering the rod-like member from said point light sources and through the light-receiving surface is preferentially scattered, with light being directed along the predetermined length of said rod-like member while also being urged out the light-emitting surface of said rod-like member, thus causing a light intensity pattern that appears substantially uniform along the light-emitting surface of said rod-like member; and a collection surface positioned near said point light sources for collecting and reflecting light not emitted directly into said rod-like member.

2. The illumination device as recited in claim 1, wherein said collection surface is adjacent a portion of the outer surface of said rod-like member.

3. The illumination device as recited in claim 1, wherein said point light sources are light emitting diodes.

4. The illumination device as recited In claim 1, in which said substantially flexible compound is impregnated with a filler, said filler deflecting light incident thereon so as to achieve the desired preferential scattering of light and causing the light intensity pattern to appear substantially uniform along the light-emitting surface of said rod-like member.

5. The illumination device as recited in claim 4, wherein said filler is a plurality of micro balloons, each having a shell and deflecting light incident thereon.

* * * * *

UNITED STATES PATENT AND TRADEMARK OFFICE

CERTIFICATE OF CORRECTION

PATENT NO. : 8,322,883 B2
APPLICATION NO. : 10/771714
DATED : December 4, 2012
INVENTOR(S) : Mark J. Cleaver et al.

It is certified that error appears in the above-identified patent and that said Letters Patent is hereby corrected as shown below:

IN THE CLAIMS:

Claim 4, Column 9, Line 1: Change "In" to -- in --.

Signed and Sealed this
Sixteenth Day of April, 2013

Teresa Stanek Rea

Teresa Stanek Rea
*Acting Director of the United States Patent and Trademark Office*